US006626306B1

(12) United States Patent
Bell

(10) Patent No.: US 6,626,306 B1
(45) Date of Patent: Sep. 30, 2003

(54) STORAGE SYSTEM

(76) Inventor: Leslie Stephen Bell, 3 South Coast Highway, Albany Western Australia 6330 (AU)

( * ) Notice: Subject to any disclaimer, the term of this patent is extended or adjusted under 35 U.S.C. 154(b) by 0 days.

(21) Appl. No.: 09/959,525

(22) PCT Filed: Apr. 28, 2000

(86) PCT No.: PCT/AU00/00372

§ 371 (c)(1),
(2), (4) Date: Jan. 16, 2002

(87) PCT Pub. No.: WO00/64309

PCT Pub. Date: Nov. 2, 2000

(30) Foreign Application Priority Data

Apr. 28, 1999 (AU) ..... PQ0036

(51) Int. Cl.[7] ..... A47F 5/00

(52) U.S. Cl. ..... 211/144; 211/133.4; 312/123; 312/324

(58) Field of Search ..... 211/131.1, 133.4, 211/163, 144, 168, 150; 312/324, 326, 123

(56) References Cited

U.S. PATENT DOCUMENTS 1,228,560 A * 6/1917 Hunter
1,785,666 A * 12/1930 Bachelder
2,239,734 A * 4/1941 Pratt
2,663,608 A * 12/1953 Schauer
2,775,498 A * 12/1956 Gettel
3,167,186 A * 1/1965 Squire ..... 211/150
4,317,606 A * 3/1982 Hastings ..... 312/123 X
4,765,470 A * 8/1988 Curci
4,971,234 A * 11/1990 Hay ..... 211/133.1 X
5,279,429 A 1/1994 Sagel
5,312,003 A 5/1994 Domenig
5,458,243 A 10/1995 McBride
5,516,203 A * 5/1996 Branham et al. ..... 312/324
6,419,332 B1 * 7/2002 Caldwell et al.

FOREIGN PATENT DOCUMENTS

| | | |
|---|---|---|
| AU | 123695 | 3/1947 |
| CA | 2044208 | 12/1992 |
| DE | 19531866 | 2/1982 |
| GB | 2 080 677 | 10/1982 |
| NL | 9200509 | 10/1993 |

* cited by examiner

*Primary Examiner*—Robert W. Gibson, Jr.
(74) *Attorney, Agent, or Firm*—Larson & Taylor, PLC

(57) ABSTRACT

A storage system (10) is described in which one or more receptacles (14) for storing articles are pivotally supported on a support shaft (12). Each receptacle (14) is provided with a bracket (16) arranged to support the receptacle and coupled to the shaft (12) in a manner to allow the bracket (16) to pivot about the shaft (12). In this way, each receptacle (14) can be individually pivoted about a shaft (12) to allow access to that receptacle and any article stored therein. The storage system (10) makes more efficient use of space and can be accessed more easily than a conventional chest of drawers or cupboard.

29 Claims, 9 Drawing Sheets

STORAGE SYSTEM

FIELD OF THE INVENTION

The present invention relates to a storage system typically, though not exclusively, in the form of a set of drawers.

BACKGROUND TO THE INVENTION

Domestic storage systems in the form of chests or sets of drawers are well known. The drawers are typically used for example in a house to store clothes or other personal effects, or say in a garage to hold tools and the like. A typical chest of drawers has an outer housing or chest provided with a plurality of openings in which drawers are located and can be slid in and out. The scale or size of the chest of drawers can vary widely from say a typical bedroom chest of drawers made from wood to small compact plastic chests having an army of drawers for holding nuts, bolts and nails and other small articles. Irrespective of their scale, the basic structure of the chest of drawers is the same.

Cupboards form another common type of storage system. A cupboard is usually of a more simple construction than a chest of drawers but is inefficient in the utilization of space. This arises because cupboards are designed with relatively large spaces between vertically adjacent shelves to allow objects to be retrieved from the back of shelves.

SUMMARY OF THE INVENTION

It is an object of the present invention to provide an alternate form of storage system.

According to the present invention there is provided a storage system including at least:

a support shaft;

one or more receptacles for storing articles;

a bracket for each receptacle, each bracket having a tubular sleeve fitted coaxially on said shaft, each receptacle being seated on a respective support frame, said support frame including two spaced apart beams, each beam configured to cradle a lower edge of said receptacle and, a further beam extending between and attached at opposite ends to each of said spaced apart beams, said sleeve being located adjacent a comer and outside of a respective receptacle.

whereby, in use, each receptacle can be individually pivoted about said shaft to allow access to that receptacle and any articles stored therein.

Preferably the storage system also includes one or more decoupling means, one of each located between the sleeves of adjacent brackets, for decoupling pivotal movement of one bracket from an adjacent bracket.

Preferably said decoupling means includes a flange that is fixed against rotation on said shaft.

Preferably said decoupling means includes a bearing located between said flange and the sleeve of an adjacent bracket.

Preferably the storage system also includes one or more spacers, each adapted to fit over said shaft, for spacing said brackets along said shaft by a distance sufficient to allow the receptacle supported on one bracket to rotate past the receptacle supported on an adjacent bracket.

Preferably said support shaft is the first of a pair of adjacent first and second support shafts, wherein a plurality of brackets are coupled to said second support shaft and arranged to support respective receptacles in a manner to allow said brackets to pivot about said second shaft, and wherein said decoupling means includes a flange provided with twin apertures that fit over the first and second support shafts to fix said flange against rotation about said shafts.

BRIEF DESCRIPTION OF DRAWINGS

Embodiments of the present invention will now be described in detail, by way of example only, with reference to the accompanying drawings in which.

DETAILED DESCRIPTION OF PREFERRED EMBODIMENTS

Figure 1:
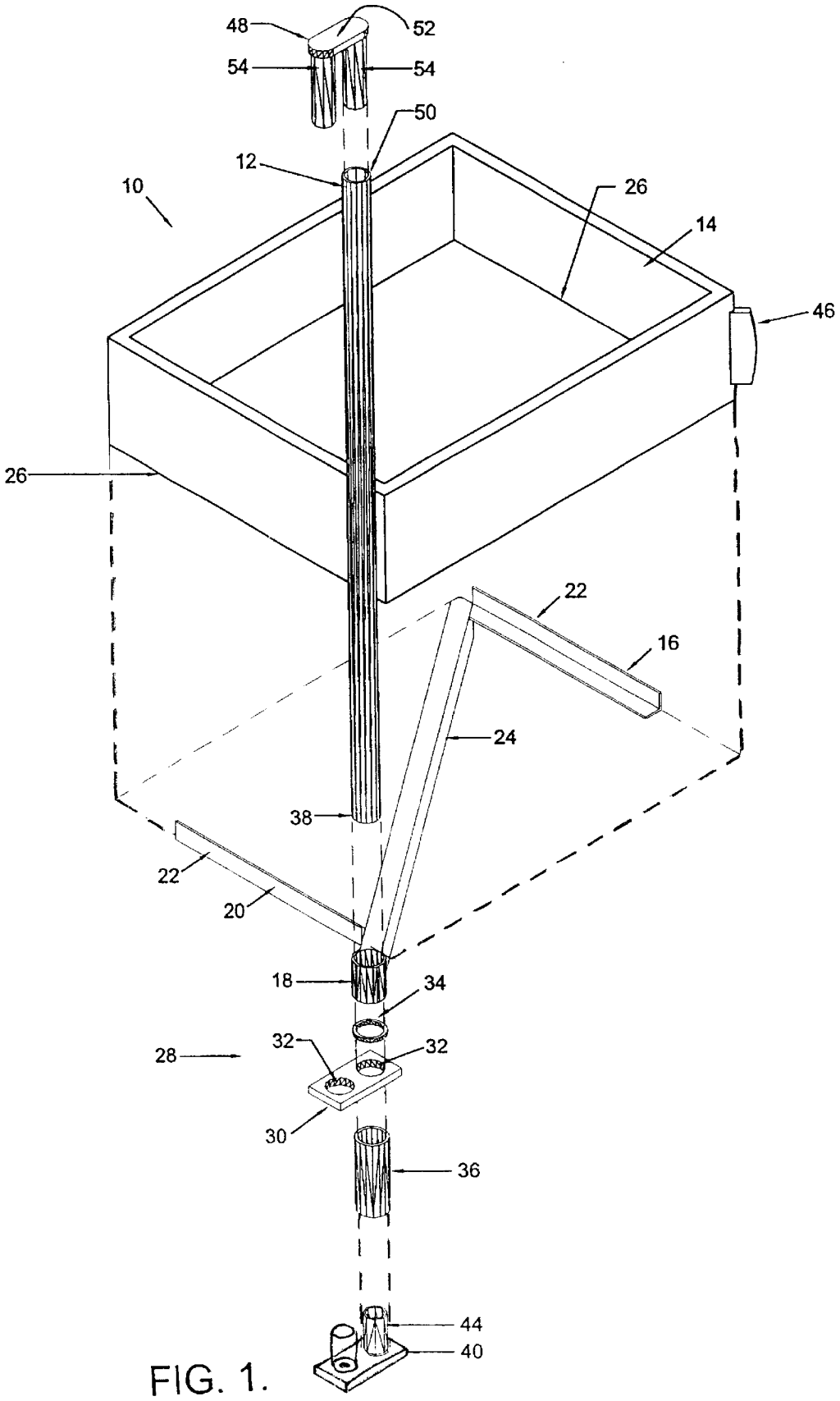
FIG. 1 is an exploded partial view of a first embodiment of a storage system in FIG. 2 is an isometric view of the storage system of FIG. 1.
Figure 2:
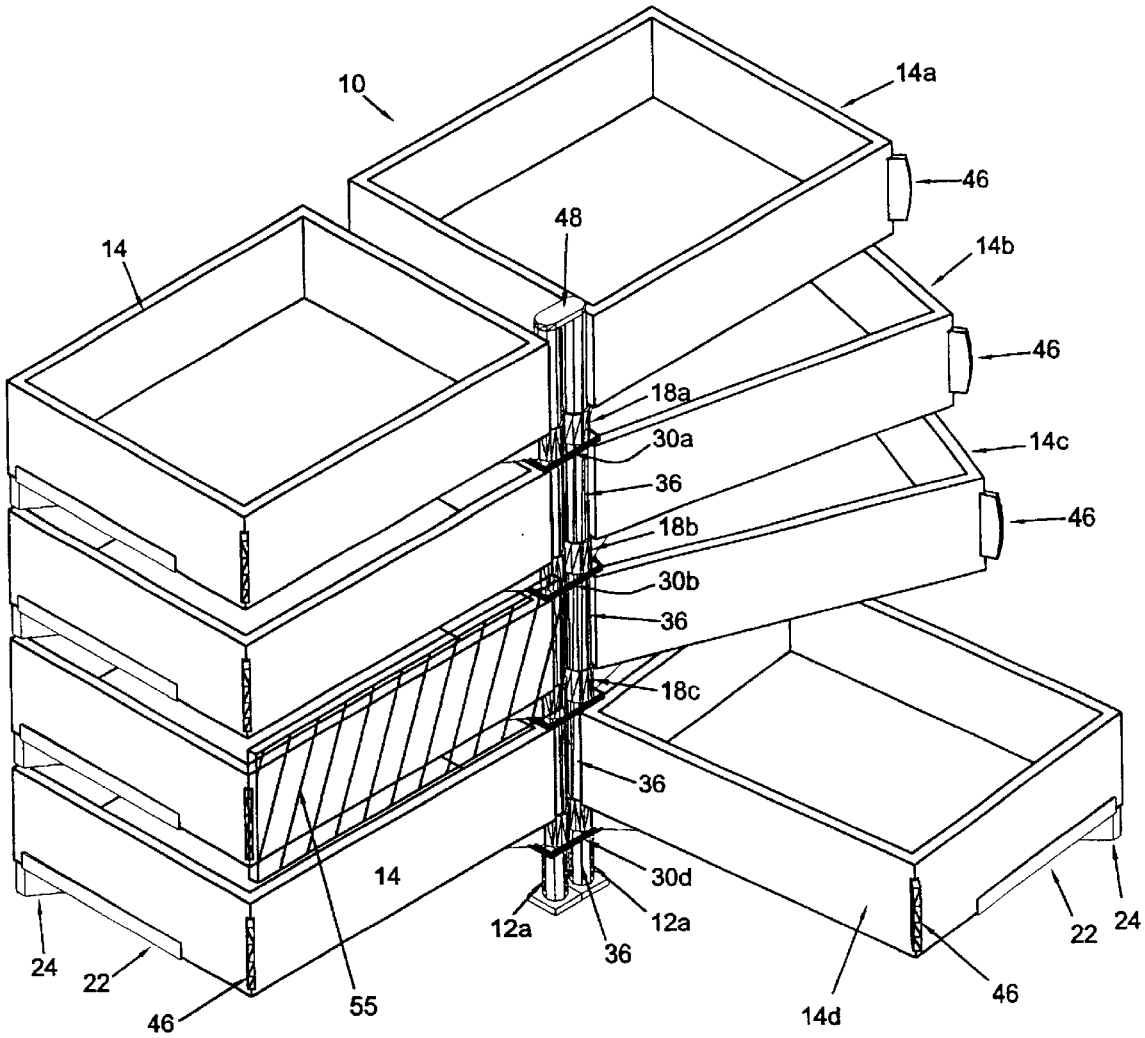

Referring to the accompanying drawings and in particular, FIGS. 1 and 2, the storage system 10 in accordance with an embodiment of this invention includes a support shaft 12, one or more receptacles 14 (only one shown in FIG. 1) for storing articles; and, a bracket 16 for each receptacle 14. Each bracket 16 is arranged to support a respective receptacle 14 and is coupled to the shaft 12 in a manner to allow the bracket 16 to pivot about the shaft 12. Preferably a pair of parallel shafts 12 are provided, as shown more clearly in FIG. 2. In this way, as shown most clearly in FIG. 2, each receptacle 14 can be individually pivoted about a respective shaft 12 to allow access to that receptacle 14 and any articles stored therein.

Looking more closely at the storage system 10, each bracket 16 is provided with a hollow tubular sleeve 18 that fits over the shaft 12 to effect a rotational coupling to the shaft 12. The bracket 16 also includes a Z shaped frame 20 having two spaced apart parallel right angle beams 22, and a diagonally extending beam 24 that connects to an opposite end of each beam 22. The frame 20 is configured so that the receptacles 14 sit on the frame 20 with the right angle beams 22 cradling lower opposite edges 26 of the receptacle 14 and the beam 24 provides support diagonally along the base of the receptacle 14. If desired, screws or other fasteners can be used to positively attach the receptacle 14 to its underlying bracket 16. The beam 24 is also fixed at one end to the sleeve 18.

Figure 3:
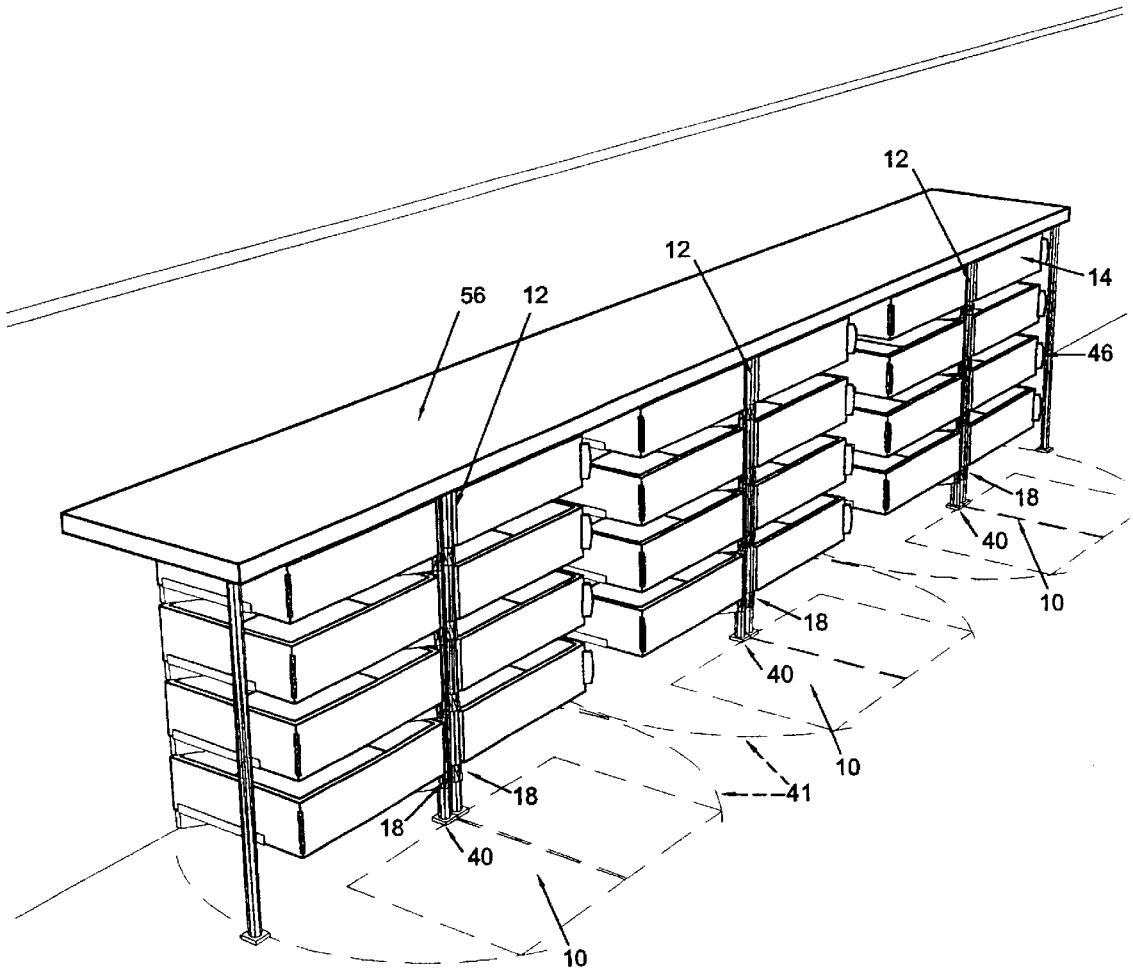
FIG. 3 is another isometric view of the storage system of FIG. 2.
Figure 4:
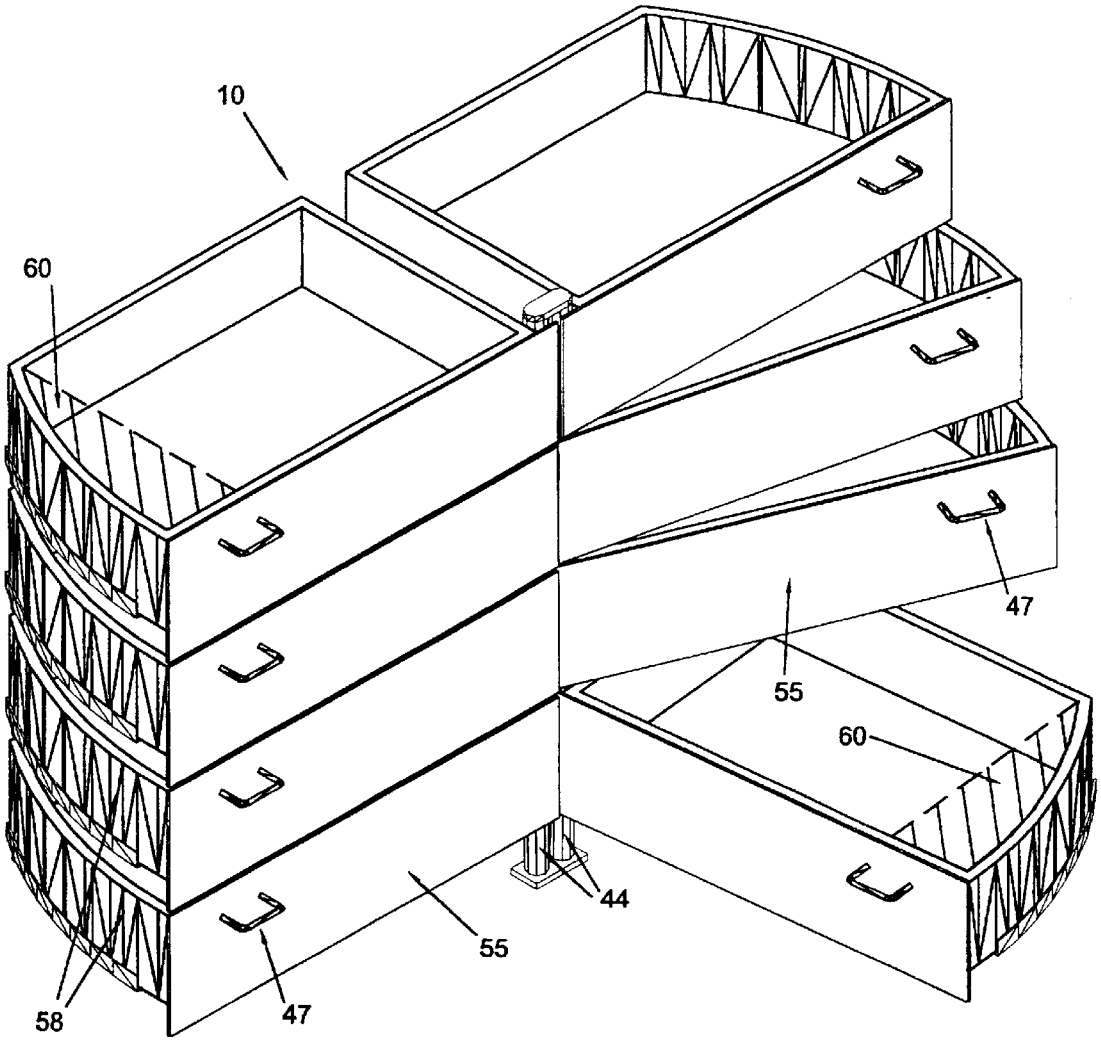
FIG. 4 is an isometric view of a variation of the embodiment of FIG. 2.

In order to limit the likelihood of the rotation of one receptacle 14 causing rotation of another receptacle 14 on the same shaft 12, decoupling means 28 is provided so as to decouple rotational motion between adjacent brackets 16. The decoupling means 28 includes a flange 30 located beneath a particular sleeve 18 of a bracket 16. The flange 30 is fixed against rotation about the shaft 12. In the case where the storage system 10 has a single shaft 12, the flange 30 may be fixed against rotation by the use of a grub screw, a clamp, or other conventional means. In the case of a twin or multi twin shaft system as depicted in FIGS. 2–4, the flange 30 can be formed with a pair of spaced apart apertures 32 that fit over adjacent shafts 12 and thereby are locked or fixed against rotation about either of the adjacent shafts 12 (see FIG. 1). To further assist in the decoupling of rotational movement a bearing 34 in the form of a plurality of ball bearings in an annular cage or bearing race is provided between the flange 30 and an upwardly adjacent sleeve 18. By virtue of this decoupling system, it can be seen, for example, in FIG. 2, that no torque is transmitted upon rotation of receptacle 14*b* to an underlying receptacle 14*c* (or indeed to the upper adjacent receptacle 14*a*). This is because as sleeve 18*b* of the corresponding bracket 16 rotates about its corresponding shaft 12, no rotational movement or torque can be transmitted through the underlying rotationally fixed flange 30*b* to the sleeve 18*c* of the bracket for lower adjacent receptacle 14*c*, nor indeed through upper adjacent flange 30*a* to the sleeve 18*a* of opposite adjacent receptacle 14*a*.

In order to provide sufficient spacing between adjacent receptacles 14 so that they can be rotated past each other a number of spacers 36 are provided which fit over a shaft 16 between the sleeves 18 of adjacent brackets 16. A spacer 36 is also provided beneath the lower most bracket 16 as depicted most clearly in FIGS. 1 and 2 to provide additional ground clearance for the bottom receptacle 14. Shaft 12 is supported at its lower end 38 by a base plate 40. Depending on whether the storage system 10 is a built-in system or portable system, the base plate 40 may be bolted or otherwise fixed to the floor; or, alternately attached to an underlying support surface such as carousel 42 depicted in FIG. 4. To facilitate this, the base 40 is formed with an upwardly extending projection 44 that fits inside lower end 38 of shaft 12. The inside of lower end 38 and the outside of projection 44 can be provided with complimentary splines to prevent rotation of the shaft 12. Alternately, if desired, grub screws or other conventional fastening means can be used to fix the lower end 38 to the projection 44.

Figure 5:
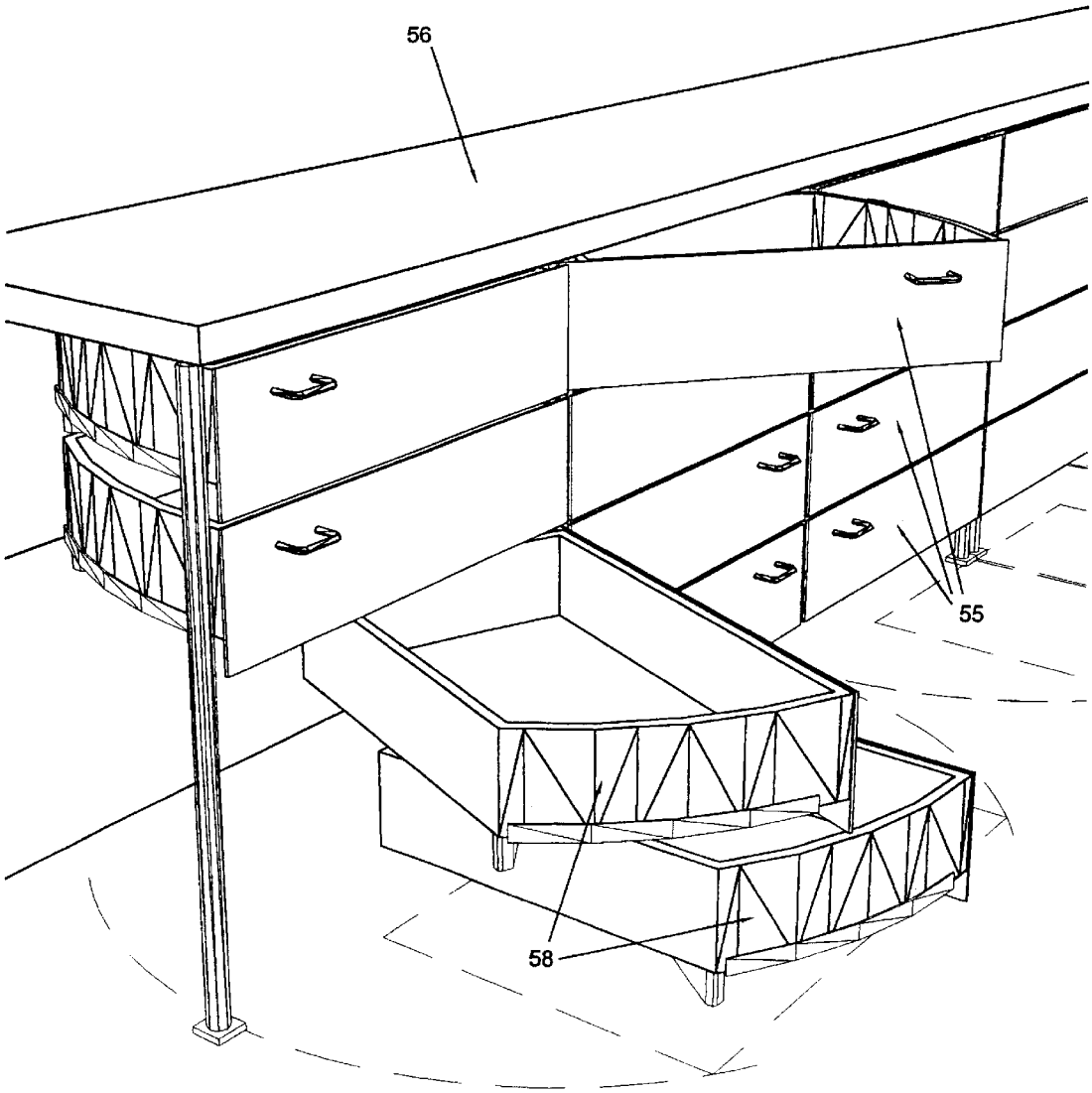
FIG. 5 is another isometric view of the storage system of FIG. 4.

The receptacles 14 are substantially in form of a conventional drawer but with the inclusion of a tab 46 extending from one of the diagonals of each receptacle 14 to provide a convenient handle to facilitate the rotation of a particular receptacle 14 about its shaft 12. Alternatively, each drawer can be fitted with a conventional drawer handle 47 and facia panel 55 as illustrated in FIGS. 4 and 5.

FIG. 2 illustrates a twin shaft system 10 in which two shafts are provided side by side to provide a twin bank of pivotable receptacles 14. In this embodiment, the flange 30 of the decoupling means 28 is as depicted in FIG. 1, namely the flange having dual apertures 32 fitting over the adjacent shafts 12. It will be appreciated that because of this connection between the flange 30 and the adjacent shafts 12, it is impossible for the flange 30 to rotate and thus torque cannot be transmitted from one rotating sleeve 18 to an adjacent sleeve 18.

To provide additional support to the shafts 12, a top connector 48 (see FIGS. 1 and 2) is provided for coupling upper ends 50 of the adjacent shafts. The top connector 48 is provided with an upper plate 52 and adjacent downwardly depending spigots 54 that are arranged to fit inside the upper ends 50 of adjacent shafts 12. The spigots 54 and the inside of the upper ends 50 can be configured to provide an interference fit. Stability of the twin shaft system can be further enhanced by providing a strut, typically extending horizontally, connecting the top connector 48 to a wall (not shown) behind the system 10.

Facia panels 55 (refer FIG. 4) are attached to the front face of each receptacle 14 to close the gap that would otherwise appear between vertically adjacent receptacles 14. In this way, visually, the storage system 10 has an appearance similar to that of a conventional chest of drawers as shown in FIG. 5. The same effect can be achieved by simply extending the front panel of each receptacle 14 in the vertical plane.

In the embodiment shown in FIG. 3, three sets of twin shaft storage systems 10 are provided side by side beneath an upper horizontal bench 56. This embodiment is well suited for application in say a garage or workshop. The form and structure of each storage system 10 is in essence identical to that depicted in FIG. 2. As can be most clearly in FIG. 3, each twin bank of pivotable receptacles 14 is spaced from an adjacent bank a predetermined distance to permit a rear comer of each receptacle 14 to pivot out in its turning circle 41 as marked in broken outline on the floor in FIG. 3. However, this is wasteful of space beneath the bench 56, and therefore FIGS. 4 and 5 illustrate a more efficient version of substantially the same embodiment of the storage system 10. In this embodiment, the receptacles 14 are extended laterally as to have a curved or arcuate side wall 58 on the side of the receptacle 14 distant from its corresponding support shaft 12. This provides the receptacles 14 with an additional storage area 60 over and above the space that would be provided if the receptacle 14 was of simple rectangular construction. The curved wall 58 accommodates the pivotal motion of each receptacle 14 about its support shaft 12. In this way, the space beneath the bench 56 is more fully utilised.

Figure 6:
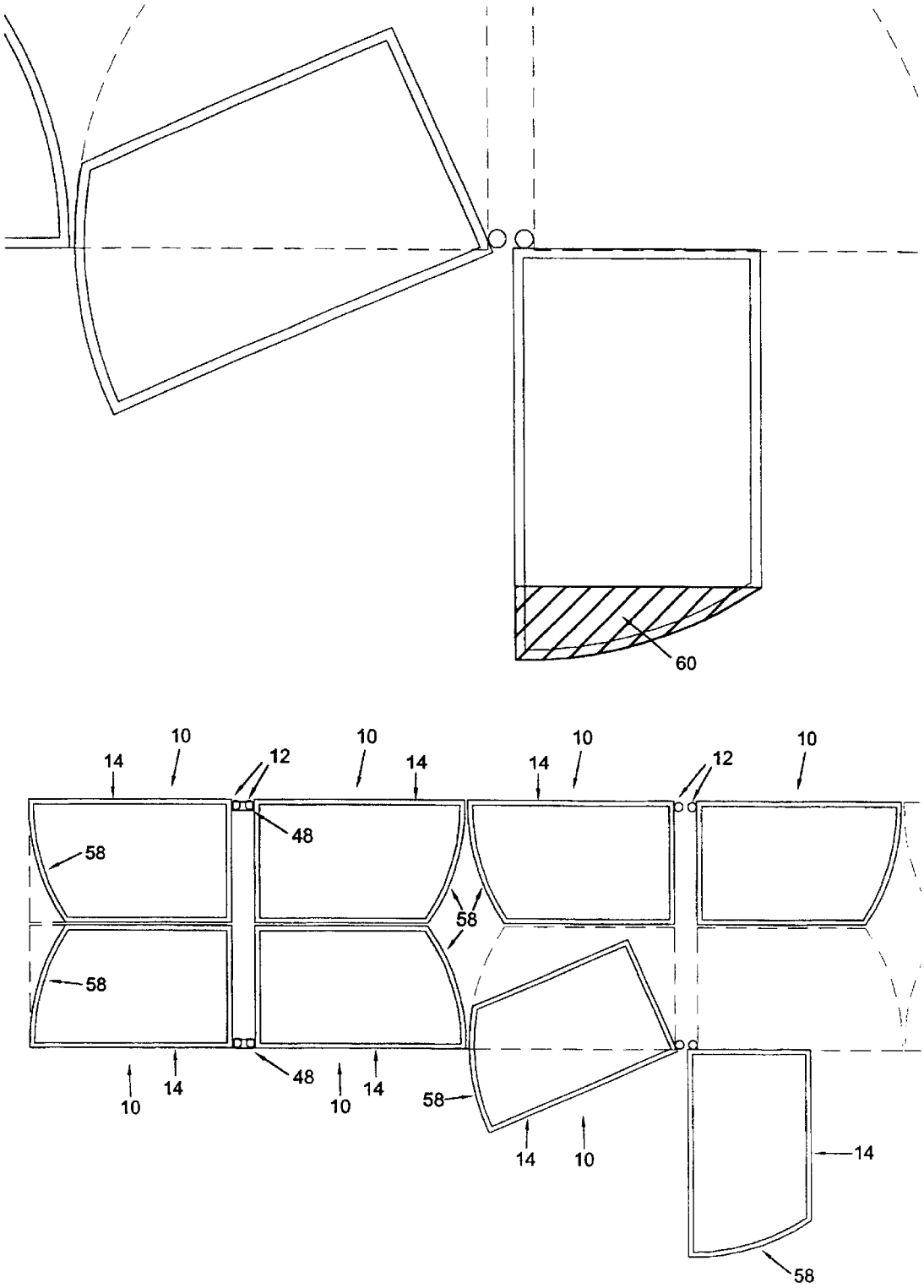
FIG. 6 is a plan view of a second embodiment of the present invention.

A further embodiment of the present invention is depicted in FIG. 6. In this embodiment, two sets of twin shaft storage systems 10 are provided arranged in two rows so as to provide a "back-to-back" configuration. In this embodiment, the receptacles 14 are extended laterally so as to have a curve or arcuate side wall 58 on the side of the receptacle 14 similar to that of the embodiment illustrated in FIGS. 4 and 5. Struts (not shown) can be provided to connect the top connectors 48 of back-to-back shafts 12 to increase the stability of the system 10.

Figure 7:
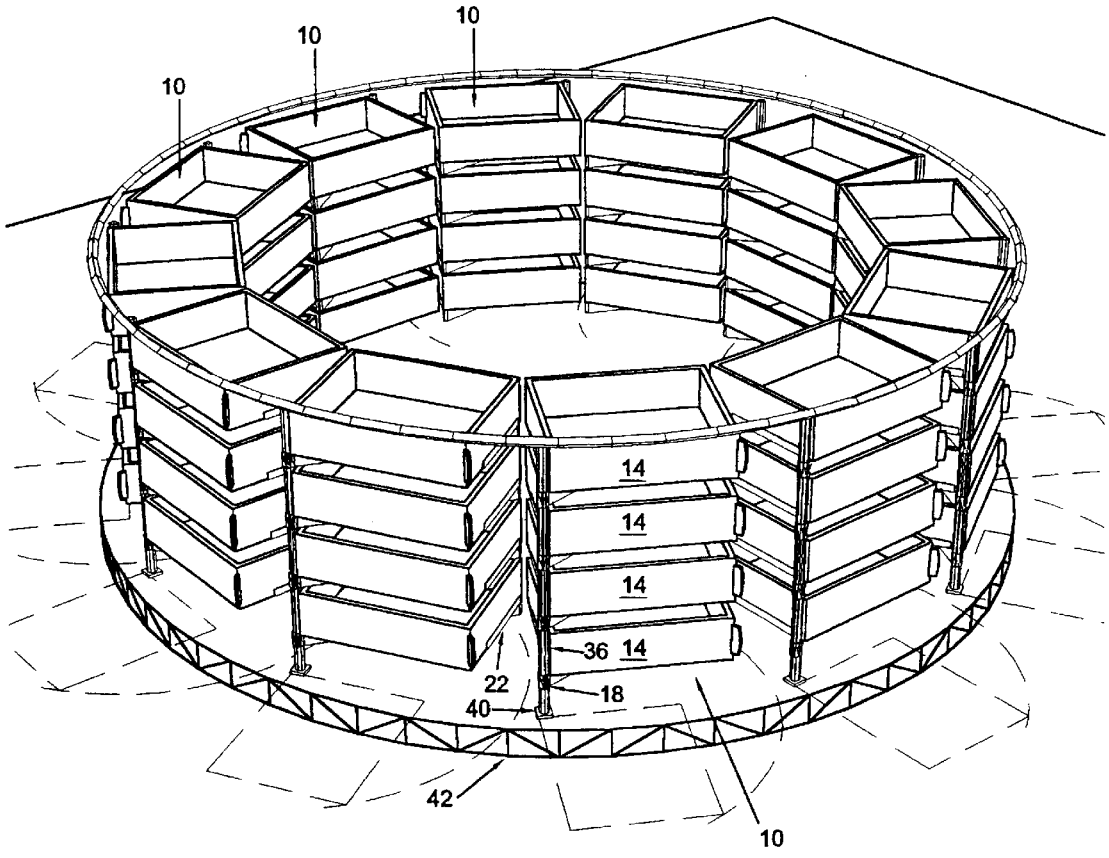
FIG. 7 is an isometric view of a fourth embodiment of the present invention.

In a further variation shown in FIG. 7, a plurality of single shaft systems 10 can be arranged on a carousel 42. Each system 10 in this embodiment includes a single shaft 12 supported at its lower end by base 40 and having a plurality of brackets 16 rotatably connected to the shaft 12 via respective sleeves 18. Each bracket 16 supporting a respective receptacle 14. In this embodiment, the carousel 42 is able to rotate about this central axis.

Figure 8:
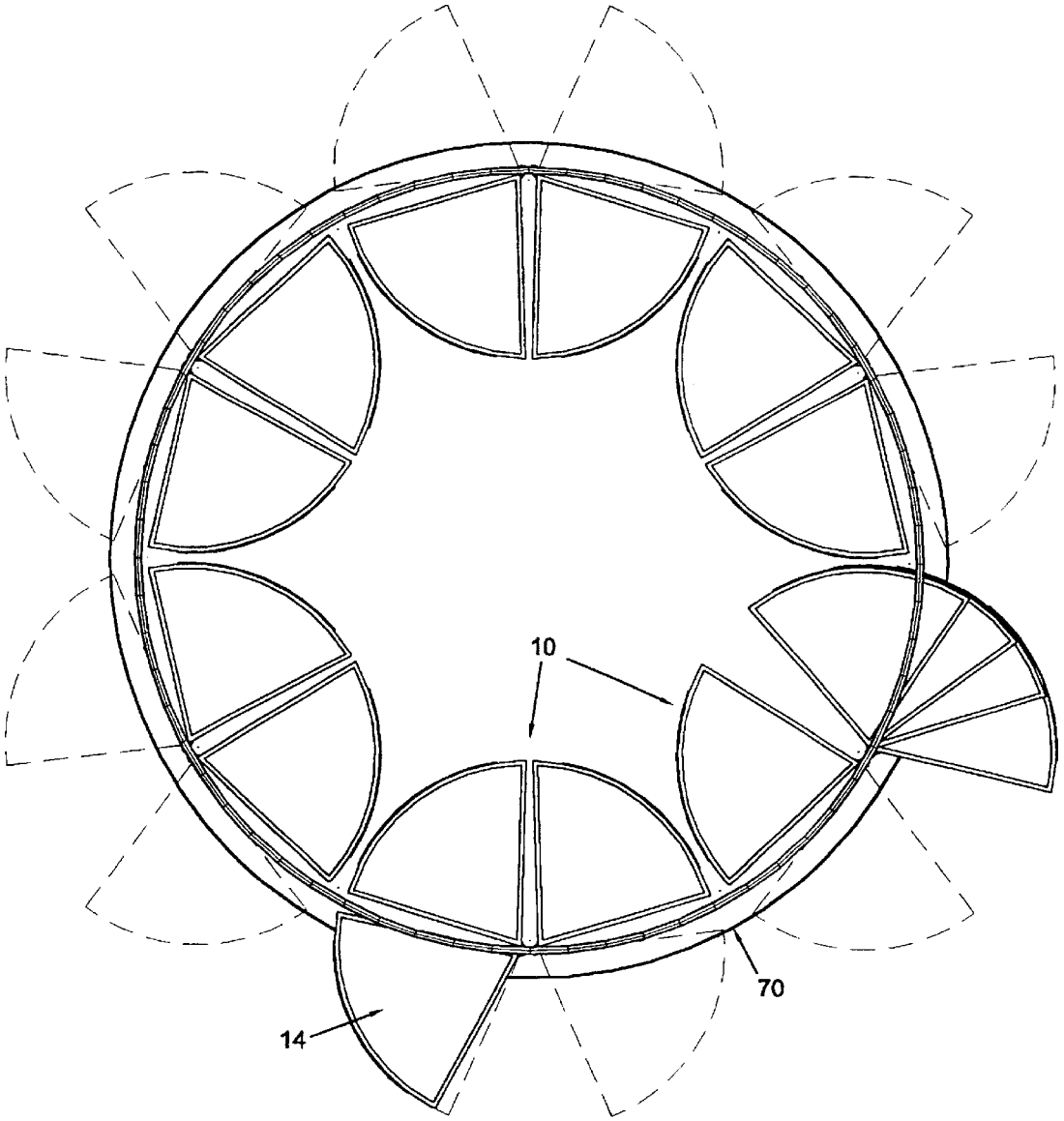
FIG. 8 is a plan view of a variation of the embodiment of FIG. 7.
Figure 9:
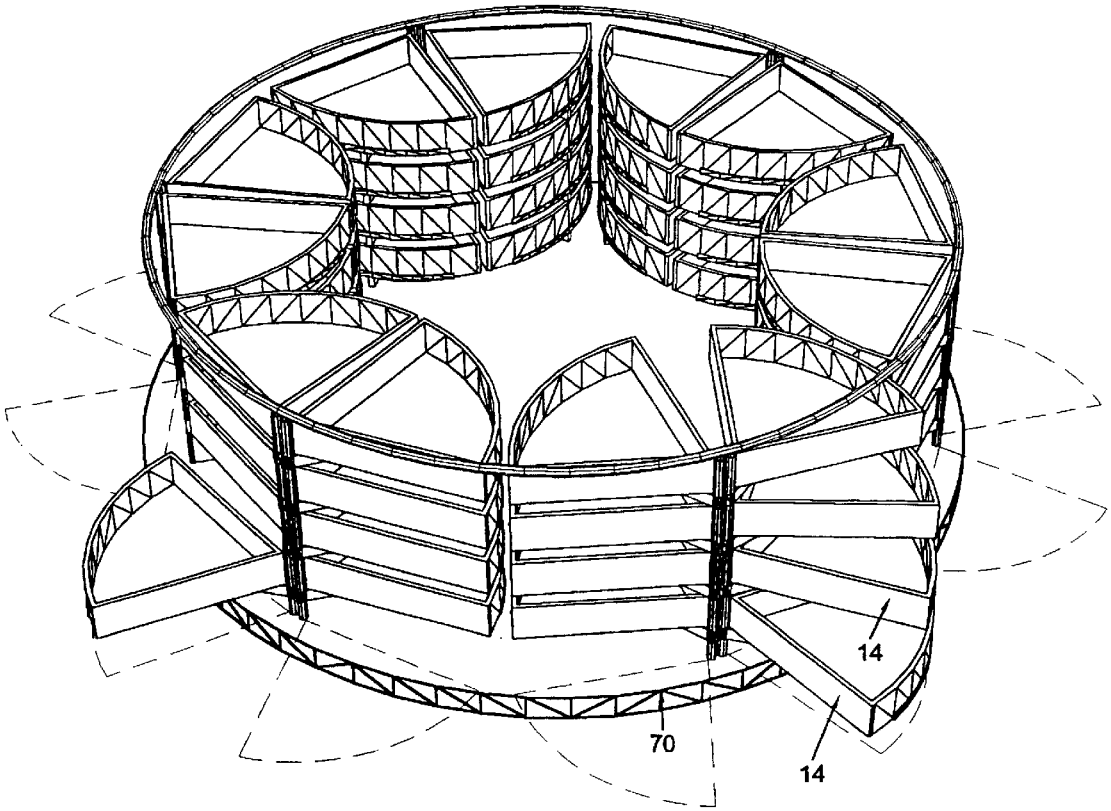
FIG. 9 is an isometric view of the storage system of FIG. 8.

FIGS. 8 and 9 illustrate a still further embodiment arranged on a carousel similar to that of FIG. 7. However, whereas the carousel 42 in FIG. 7 employs a plurality of single shaft storage systems 10, the embodiment of FIGS. 8 and 9 employs a plurality of twin shaft storage systems 10 similar to that of FIG. 4. However, in this embodiment each of the receptacles 14 is segment-shaped in order to better utilise the space between the adjacent storage systems on the carousel 70. In other respects, each set of twin shaft storage systems 10 illustrated in the embodiment of FIGS. 8 and 9 is structurally and functionally similar to that of the previous embodiments.

From the above description it is clear that embodiments of the present invention enjoy numerous advantages over current chests of drawers and cupboards. As the receptacle 14 can be swung away from any overlying receptacle, storage areas of the receptacles can be easily accessed to retrieve stored articles or return them to a particular position in the receptacles 14. There is virtually no likelihood of jamming of the receptacles as is common with conventional drawers and chests of drawers. This makes the system 10 easy to use especially for children and the elderly. Further, because of the strength of the support shafts 12, they can double as supports for bench tops and the like. This allows the system 10 to be easily constructed or erected by builders during home renovations or when building a house. Embodiments of the system can be used in unlimited form and many and varied applications such as in ships, homes, planes, factories, storage sheds, wine cellars for storing wines and even as filing units.

Now that embodiments of this invention have been described in detail it will be apparent to those skilled in the relevant arts and numerous modifications and variations may be made without departing from the basic inventive concepts. For example, in the embodiments shown, each system 10 is provided with a stack of four receptacles 14. However any number of brackets 16 (and by implication receptacles 14) can be supported along a single shaft 12. Also, the frame 20 of each bracket 16 can be formed in different configurations other than the Z configuration depicted. For example, the frame 20 can be in the form of a rectangular frame to seat all of the lower edges of the receptacle 14 and having one or two diagonal cross beams 24. Further, if desired, the spacers 36 can be omitted and the sleeves 18 increased in length so as to provide sufficient spacing for the adjacent receptacles 14. In addition, each receptacle can be fitted with a lid to keep out dust, mice or other unwanted substances, to improve security and/or hygiene. Locks and catches can be added to each of the receptacles 14 in a conventional manner.

All such modifications and variations together with others that would be obvious to a person of ordinary skill in the art are deemed to be within the scope of the present invention the nature of which is to be determined from the foregoing description and the dependent claims.

What is claimed is:

1. A storage system including at least:

a support shaft;

one or more receptacles for storing articles, each receptacle having a portion defining a corner;

a bracket for each receptacle, each bracket having a tubular sleeve fitted coaxially on said shaft and a support frame coupled to said sleeve, each receptacle being seated on a respective support frame, said support frame including two spaced apart beams, each beam configured to cradle a lower edge of said receptacle and, a further beam extending between and attached at opposite ends to each of said spaced apart beams, said sleeve being located adjacent a corner and outside of the respective receptacle.

2. A storage system as defined in claim 1, including at least two adjacent brackets, and wherein the storage system also includes a decoupling means located between the sleeves of the adjacent brackets, for decoupling pivotal movement of one bracket from the adjacent bracket.

3. A storage system as defined in claim 2, wherein said decoupling means includes a flange that is fixed against rotation on said shaft.

4. A storage system as defined in claim 3, wherein said decoupling means includes a bearing located between said flange and the sleeve of the adjacent bracket.

5. A storage system as defined in claim 4, wherein the storage system also includes one or more spacers, each spacer adapted to fit over said shaft, for spacing said brackets along said shaft by a distance sufficient to allow the receptacle supported on one bracket to pivot past the receptacle supported on the adjacent bracket.

6. A storage system as defined in claim 2, wherein said support shaft is the first of a pair of adjacent first and second support shafts, wherein a plurality of brackets are coupled to said second support shaft and arranged to support a plurality of receptacles in a manner to allow said brackets to pivot about said second shaft.

7. A storage system as defined in claim 6, wherein said decoupling means includes a flange provided with twin apertures that fit over the first and second support shafts to fix said flange against rotation about said shafts.

8. A storage system as defined in claim 7, wherein each of said receptacles is provided with a curved side wall on a side of the receptacle that farthest from said tubular sleeve.

9. A storage system including at least:

a support shaft;

one or more receptacles for storing articles, each receptacle having a portion defining a corner; and a bracket for each receptacle, each bracket having a tubular sleeve fitted coaxially on said shaft and a support frame coupled to said sleeve, said support frame including a first beam coupled to said sleeve and a second beam coupled to said first beam, each receptacle supported by said first and second beams, said tubular sleeve being located adjacent the corner and outside of a respective receptacle.

10. The storage system according to claim 9 wherein said second beam is configured to cradle a lower edge of said receptacle.

11. The storage system according to claim 9 further including one or more fasteners for attaching said receptacle to said support frame.

12. The storage system according to claim 9 further including a horizontal bench top supported by said one or more shafts and beneath which said receptacle can be located.

13. A storage system as defined in claim 9, including at least two adjacent brackets, and wherein the storage system also includes a decoupling means located between the sleeves of the adjacent brackets, for decoupling pivotal movement of one bracket from the adjacent bracket.

14. A storage system as defined in claim 13, wherein said decoupling means includes a flange that is fixed against rotation on said shaft.

15. A storage system as defined in claim 14, wherein said decoupling means includes a bearing located between said flange and the sleeve of the adjacent bracket.

16. A storage system as defined in claim 15, wherein the storage system also includes one or more spacers, each spacer adapted to fit over said shaft, for spacing said brackets along said shaft by a distance sufficient to allow the receptacle supported on one bracket to pivot past the receptacle supported on the adjacent bracket.

17. A storage system as defined in claim 13, wherein said support shaft is the first of a pair of adjacent first and second support shafts, wherein a plurality of brackets are coupled to said second support shaft and arranged to support a plurality of receptacles in a manner to allow said brackets to pivot about said second shaft.

18. A storage system as defined in claim 17, wherein said decoupling means includes a flange provided with twin apertures that fit over the first and second support shafts to fix said flange against rotation about said shafts.

19. A storage system as defined in claim 18, wherein each of said receptacles is provided with a curved side wall on a side of the receptacle that farthest from said tubular sleeve.

20. A storage system including at least:

a support shaft;

two or more receptacles for storing articles each receptacle having a portion defining a corner; and, two or more adjacent brackets, one bracket for each receptacle, each bracket having a tubular sleeve fitted coaxially on said shaft and a support frame coupled to said sleeve, each receptacle being seated on a respective support frame, said tubular sleeve being located adjacent the corner and outside of a respective receptacle, a decoupling means located between the sleeves of the adjacent brackets, for decoupling pivotal movement of one bracket from the adjacent bracket.

21. The storage system according to claim 20 wherein said support frame includes a first beam coupled to said sleeve and a second beam coupled to said first beam, said receptacle supported by said first and second beams.

22.The storage system according to claim 21 wherein said second beam is configured to cradle a lower edge of said receptacle.

23. The storage system according to claim 21 further including a horizontal bench top supported by said one or more shafts and beneath which said receptacle can be located.

24. A storage system as defined in claim 21, wherein said decoupling means includes a flange that is fixed against rotation on said shaft.

25. A storage system as defined in claim 24, wherein said decoupling means includes a bearing located between said flange and the sleeve of the adjacent bracket.

26. A storage system as defined in claim 25, wherein the storage system also includes one or more spacers, each spacer adapted to fit over said shaft, for spacing said brackets along said shaft by a distance sufficient to allow the receptacle supported on one bracket to pivot past the receptacle supported on the adjacent bracket.

27. A storage system as defined in claim 20, wherein said support shaft is the first of a pair of adjacent first and second support shafts, wherein a plurality of brackets are coupled to said second support shaft and arranged to support a plurality of receptacles in a manner to allow said brackets to pivot about said second shaft.

28. A storage system as defined in claim 27, wherein said decoupling means includes a flange provided with twin apertures that fit over the first and second support shafts to fix said flange against rotation about said shafts.

29. A storage system as defined in claim 28, wherein each of said receptacles is provided with a curved side wall on a side of the receptacle that farthest from said tubular sleeve.

* * * * *